United States Patent [19]

Cycowicz et al.

[11] 4,035,852

[45] July 19, 1977

[54] PULL OUT SOFA BED

[75] Inventors: Izchak Cycowicz, Brooklyn, N.Y.; Glenn G. Gill, Bayonne, N.J.

[73] Assignee: Mohasco Corporation, Amsterdam, N.Y.

[21] Appl. No.: 730,857

[22] Filed: Oct. 8, 1976

[51] Int. Cl.[2] ..... A47C 17/14

[52] U.S. Cl. ..... 5/13; 5/29; 5/55 B

[58] Field of Search ..... 5/13, 29, 37, 42, 55 B

[56] References Cited

U.S. PATENT DOCUMENTS

| | | | |
|---|---|---|---|
| 3,740,775 | 6/1973 | Metayer | 5/13 |
| 3,871,035 | 3/1975 | Gerth | 5/13 |
| 3,903,553 | 9/1975 | Metayer | 5/13 |
| 3,984,883 | 10/1976 | Wong | 5/13 |

*Primary Examiner*—Casmir A. Nunberg
*Attorney, Agent, or Firm*—J. B. Felshin

[57] ABSTRACT

This pull out sofa bed is an improvement of the sofa bed disclosed in U.S. Pat. No. 3,984,883 dated Oct. 12, 1976 and assigned to the assignee of the present application. In said patent bed there is in effect a lost motion during which no work of compressing the mattress is being performed while slack is being taken up. Consequently the work required to compress the mattress and create the necessary locking of the compressed mattress, is concentrated over a relatively short part of the closing cycle of the folding of the bed. The result of this is that a relatively high "peak" force is required at this portion of the cycle to close the bed and compress the mattress and lock the bed in closed position, thereby requiring exertion of considerable strength by the person closing the bed. The patented bed is satisfactory when the mattresses were made of polyfoam. However, heavy inner-spring mattresses are now being used also and it takes greater strength to fold the beds when using such heavy inner-spring mattresses. The bed disclosed herein has means for spreading the work necessary to compress the mattress over a much larger portion of the closing cycle, thereby reducing the peak force required to close the bed. Another shortcoming of the bed of U.S. Pat. No. 3,984,883 was that the installation of the helical spring when used in a maximum tension position of multi-tension positions, was very difficult. Another shortcoming was that the high force required to stretch the helical coincided in the bed closing cycle with the peak of the mattress compression force and was additive in causing an excessively high closing requirement. In the present design, one end of the main helical spring is anchored to one of a plurality of holes equidistant from the pivot point of the main lever controlled by the spring thus permitting a far simpler installation.

25 Claims, 6 Drawing Figures

PULL OUT SOFA BED

This invention relates to pull out sofa beds.

An obviously desirable feature of a folding sofa bed is that it may be opened and closed with a minimum of effort and strength required on the part of the person using it. Concommittantly, the closed bed has to conform to a positive predetermined configuration so as to fit within the sofa frame with the proper, front, rear and floor clearances and also seating height and pitch. The area of this closed configuration, commonly referred to as the "box" should ideally be as compact as possible to permit the greatest latitude in styling and interchangeability by the furniture manufacturers. With sofa beds using polyfoam mattresses, achieving these several features has been accomplished by numerous designs. However, many manufacturers now wish to use heavy inner spring mattresses in some sofas in their line, and also to do so with the same bed mechanism they use for the lighter polyfoam mattress receiving constructions.

The force required to fold and compress inner spring mattresses into the relatively small box is great, as compared with the force required to fold the polyfoam mattress.

Most sofa beds designs employ a system of linkage commonly referred to as the "lock" which affects the necessary compression and then "locks" it into the final predetermined space in the sofa frame by a positive mechanical means, so as to give a uniform "box" condition regardless of the mattress used.

In the design of the bed covered under U.S. Pat. No. 3,984,883 dated Oct. 12, 1976, the lock was achieved by transmission through the linkage of the manual force being applied to push the folded bed into the sofa frame causing rotation of the Main Bell Crank 106 which pulls on the Main Lock Link 112 causing a pull and rotation of the Center Angle 25 and Front Tube Lock Link 118 thus pulling the folded over Front section or Tube 16 rearward and downward, thus compressing the mattress until the predetermined final box shape is reached when the stop surface on the Main Lock Link and the Front Tube Lock Link meet, thus stopping all further rotation in this part of the bed. The closed bed is locked in this position by a ⅛ inch interference in the "in line" condition of the centers of the juncture of the Main Bell Crank and the Slotted Lock Link, the juncture of the Main Bell Crank and Main Angle and the juncture of the Slotted Lock Link and the Main Lock Link.

The shortcoming of the system described in U.S. Pat. No. 3,984,883 was that in order to satisfy another condition — namely that the rear leg must remain on the floor to support the bed in the initial—first fold-position (FIG. 2) and inasmuch as the closing of this leg is accomplished by the same means as the activation of the lock, that is, the rotation of the Main Bell Crank, pulling the Slotted Lock Link etc., it was necessary to have a relatively long slot in the Slotted Lock Link (Approx. 3½inch) to allow the free movement of the rivet connecting it to the Main Lock Link as the bed is folded, thus moving the Main Lock Link without moving the Slotted Link and thereby collapsing the leg.

Subsequently in the next sequence of operation in closing the bed, the Slotted Lock Link is pulled by the Main Bell Crank again traversing the entire length of the slot before the rivet attached to the Main Lock Link is engaged by the end of the slot to commence the mattress compression and locking action. This is in effect lost motion as no work of compressing the mattress is being preferred while the "slack" is being taken up. Consequently the work required to compress the mattress and create the necessary lock interference is concentrated over a relatively short part of the closing cycle. The result of this is that a relatively high peak force is required at this portion of the cycle to close the bed requiring considerable strength by the person closing the bed.

The construction submitted herein, overcomes this deficiency by reducing the lost motion so as to enable the work necessary to compress the mattress to be spread over a much larger portion of the closing cycle thereby greatly reducing the peak force required to lose the bed. This is accomplished by replacing the Slotted Lock Link 118 of U.S. Pat. No. 3,984,883, with three links — a new shorter Slotted Lock Link with a shorter slot, a Secondary Bell Crank and a Lock Sequence Link to be described hereinafter. This system of linkage in effect translates the lost motion aspect from a slot of 3½ inch to a slot of less than 2 inches.

Improved Helical Tension Device

Another desirable feature is that the sofa bed may be opened easily. Also that the helical tension spring which is used to assist lifting the folded bed from the sofa have adjustable features so as that it can be used with mattresses of various weights and also that it be easy to install. (It is installed by the furniture manufacturer.)

In U.S. Pat. No. 3,984,883 the helical spring was connected from a tension link that pivoted freely on its connection point on the Main Lever 61 and had three holes at different distance from this pivot to provide the adjustable feature (varying length of stretch and consequent tension). The shortcomings of this design are that installation of the helical when used in the maximum tension mode was very difficult and it would be even more difficult to install if the maximum tension distance were increased. The range of adjustment was restricted and it was therefore not possible to attain the desired heavy tension to make opening of a bed with a heavy inner spring mattress without causing too much tension on the lightest position used for light weight mattresses which would create the undesirable condition of having the bed jump out of the sofa frame by itself.

Another shortcoming of the bed of U.S. Pat. No. 3,984,883, was that a high force required to stretch the helical coincided in the bed closing cycle with the peak of the mattress compression force and hence was additive in causing an excessively high closing force requirement.

The design herein uses the same basic connection system as the original. However, the tension link is designed so that in the open bed position all three holes are equidistant from the pivot point on the main lever — thus permitting far simpler installation of the helical spring. (FIG. 1). The pivot point is also relocated so that it starts above center and as the main lever is rotated very little tension is put on the helical in the earlier part of the closing cycle. After the bed is partially closed, the tension link which due to the pull exerted by the helical, has rotated to a point where a stop surface on it engages a stop surface on the edge of the main lever thus halting further rotation of the tension link relative to the main lever. The pull exerted on the helical is accelerated from this point onward until the bed is fully closed and the full extension of the helical is reached (FIG. 4). This arrangement permits a much wider variation in helical tension adjustment from light to heavy tension. It also delays the high force point required to stretch it beyond the peak force point of mattress compression thus reducing the combined peak force required to close the bed while also enabling easier opening of heavy mattresses because of the increased helical tension possible with this design.

An object of this invention is to generally improve the construction disclosed in said U.S. Pat. No. 3,984,883 in the manner described above.

Still another object of this invention is to provide a pull out sofa bed of the character described which shall be easy to manipulate for opening and closing, inexpensive to manufacture and assemble, which shall be strong and durable, and which shall yet be practical and efficient to a high degree in use.

Other objects of this invention will in part be obvious and in part hereinafter pointed out.

The invention accordingly consists in the features of construction, combinations of elements, and arrangements of parts which will be exemplified in the construction hereinafter described and of which the scope of invention will be indicated in the following claims.

Figure 1:
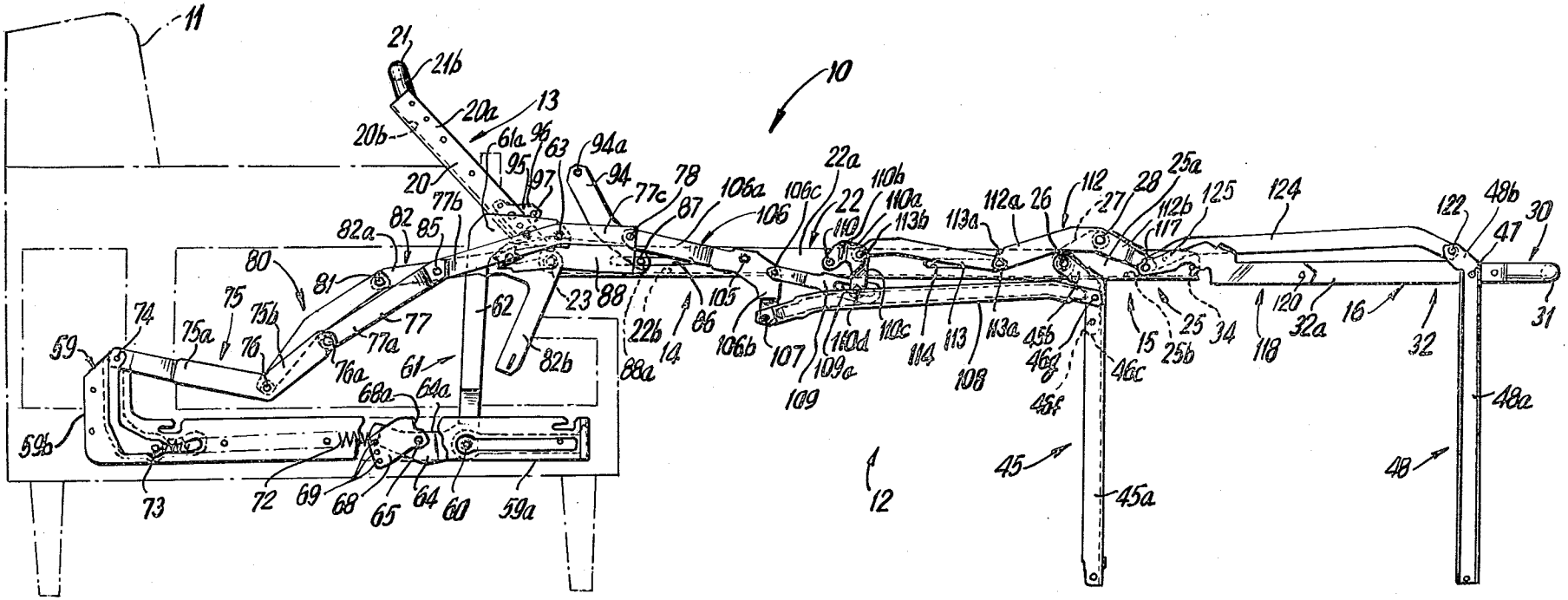
FIG. 1 is a side elevational view of an opened up, fully extended pull out sofa bed embodying the invention, and showing the tension spring connected for least tension.

Referring now in detail to the drawing, 10 designates a pull out sofa bed comprising a sofa bed wood frame 1 to which a metal foldable or collapsible bed 12 is connected. Said bed 12 comprises a rear or head section 13, a long intermediate or main section 14 pivotally connected at one end to said head section, a short intermediate or central section 15 pivotally connected at one end to the other end of said long intermediate section 14, and front or foot section 16 pivotally connected to the other end of said short intermediate or central section 15. The head section 13 comprises left and right rear side angles 20 which are similar and symmetrically disposed, and interconnected by a cross tube 21 riveted at the ends thereof to the rear ends of said side angles. Each rear side angle has a flange **20*a* extending upwardly from the outer end of an inwardly extending horizontal flange 20*b***.

Member 21 is made of tubular stock and its tubular arms **21*b* are each flattened into angular shape to form a vertical flange and a horizontal flange and which are interfitted with and riveted to adjacent ends of the vertical flange 20*a* and horizontal flange 20*b* of a rear side angle 20**.

The long intermediate section 14 comprises similar, symmetrically disposed left and right main angles 22, each having an outer vertical flange **22*a* extending up from an outer end of a lower inwardly extending horizontal flange 22*b*. The vertical flanges 20*a* are pivoted at their right ends by rivets 23 to the left ends of flanges 22*a***.

The short intermediate section 15 comprises left and right similar, symmetrically disposed center angles 25, each comprising a vertical outer upwardly extending flange **25*a* and a lower, inwardly extending horizontal flange 25*b*. The right ends of flanges 22*a* of the main angles 22, are hinged to the left ends of flanges 25*a* of the center angles 25, by pivot rivets or pins 26**.

Vertical flanges **25*a* have upward triangular extensions 27 rising above the level of the upper edges of flanges 22*a* and carry a pivot rivet or pin 28** at the apex of said extension, for the purpose hereinafter appearing.

The foot section 16 comprises a front member 30 of tubular stock, comprising an end tube portion 31 from which parallel tube arm portions 32 extend. The parallel tube arm portions 32 are compressed to form flattened vertical flanges **32*a* pivotally connected at their left ends to right ends of flanges 25*a* of the center angles by pivot pins or rivets 34. Portions 32 are horizontal when the bed is pulled out and in sleeping position, as shown in FIGS. 1**.

The sections 13, 14, 15 and 16 together form a rectangular frame with curved corners, when the bed is fully pulled out. Attached to said frame is a linkage to form a usual platform or support for a mattress (not shown). The platform is connected to the frame in the usual manner by coil tension springs to support the mattress.

Pivoted to pivot pins or rivets 26 are similar, symmetrically disposed rear legs 45 each having a long vertical portion **45*a* (when the bed is fully pulled out), and an upwardly and rearwardly inclined portion 45*b*, the upper end of which is pivoted to said pin 26. A rear leg patch 46*c* reinforces the upper end of leg 45. It has a top arm inclined upwardly and rearwardly, like arm 45*b* of the leg 45, and a lower arm alongside the upper end of leg portion 45*a*. Patch 46*c* receives pivot 26 and is riveted to the rear leg as at 46*f*. At the junction of arms 46*d*, 46*e* of path 46*c* is a pivot pin 46*g*** for the purpose hereinafter appearing.

Pivoted to arms 30 as on pivot pins or rivets 47 are similar symmetrically disposed front legs 48, each having a vertical long portion **48*a* (when the bed is fully pulled out) and a short upwardly and rearwardly inclined portion 48*b* at the upper end of portion 48*a***.

Figure 2:
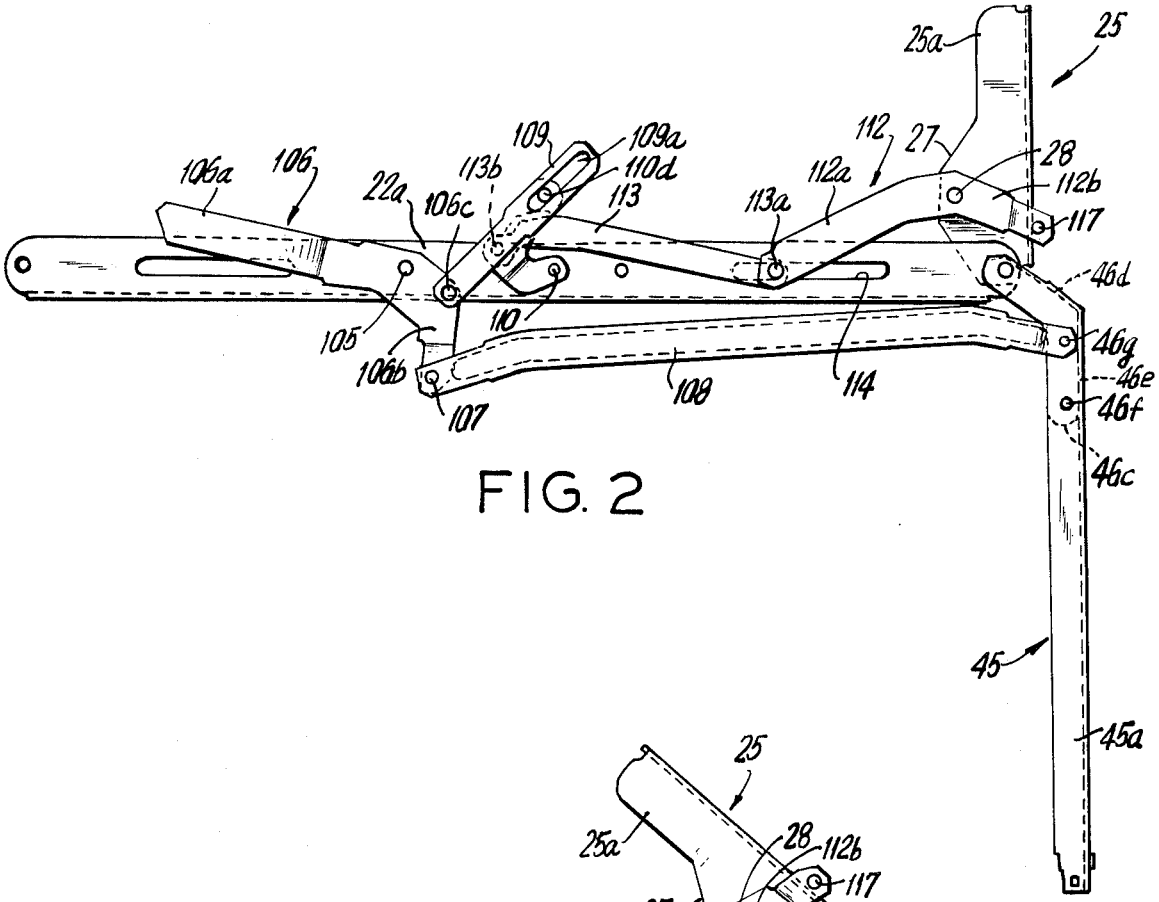
FIG. 2 is a partial side elevational view of the locking portion of the bed with the front section first raised to vertical position to extend up 90° from the center section and with the center section then raised to vertical position extending up from the main section and with the front section overlying the main section and raised thereabove.
Figure 3:
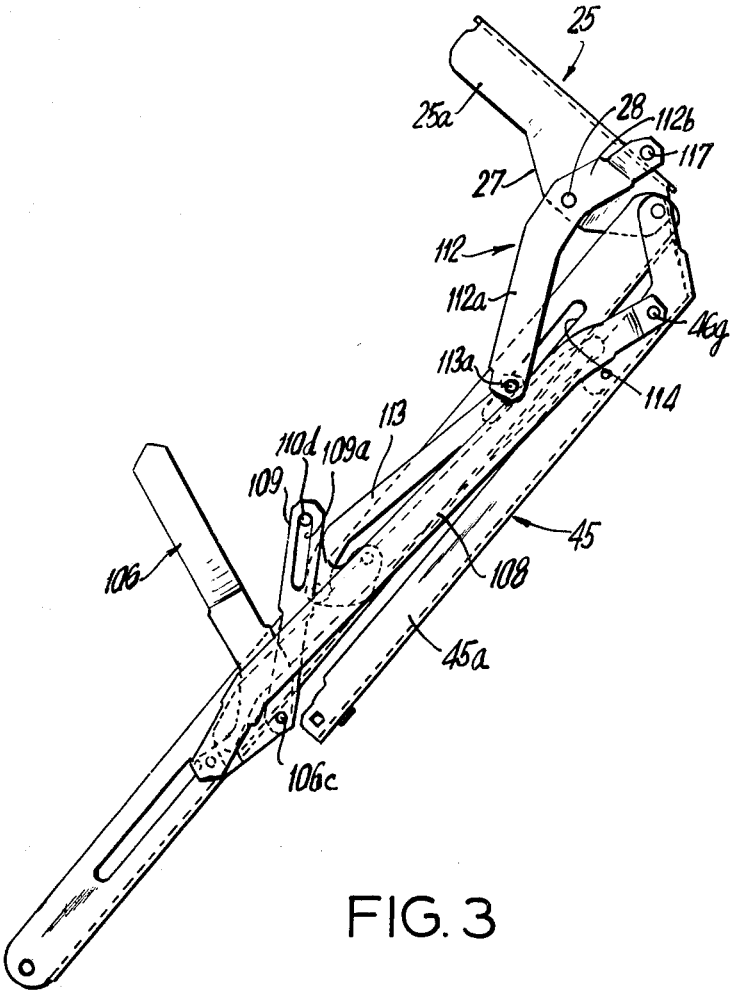
FIG. 3 is a side elevational view of the part of the bed shown in FIG. 2, with the parts moved from a FIG. 2 position downwardly and rearwardly to an angular position into the sofa frame.
Figure 4:
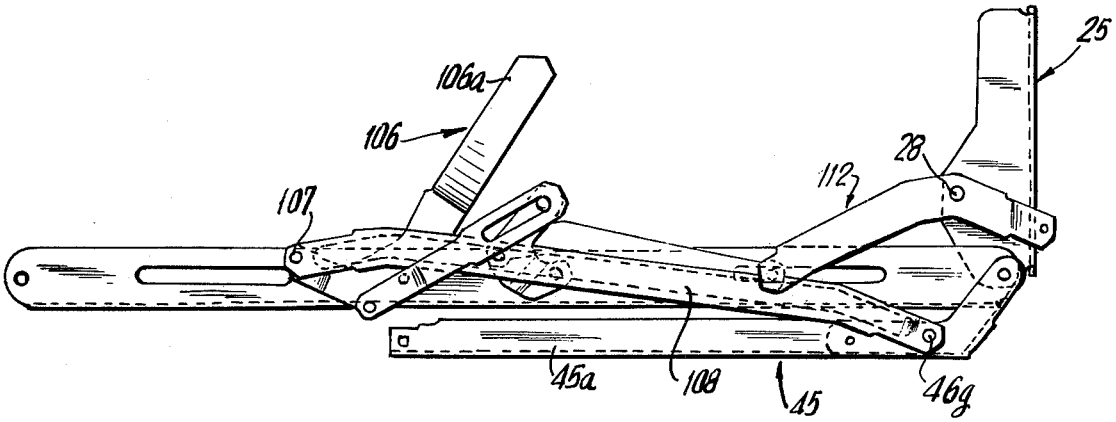
FIG. 4 is a view of the part of the bed shown in FIG. 3, in fully collapsed position in the sofa frame.

Means is provided to connect the bed sections 13 14, 15, 16 and the legs 45, 48 in such manner that the bed will be supported in pulled out condition for sleeping, connected to a right chassis 59 and a left chassis 59, (only the right chassis 59 is shown), both fixed to the wood bed frame 11, and can be collapsed by first unfolding the foot section 16 through an angle of 90° to the dot-dash position of FIG. 1, then swinging the upfolded foot section 16 and the short intermediate section 15, together through an angle of 90° to position of FIG. 2, and then first moving the bed from the position of FIG. 2 to the position of FIG. 3 and then to the fully collapsed position of FIG. 4.

The chassis 59 on both sides of the bed are similar and symmetrically disposed. Since the means which connects the longitudinal portions of the bed frame on the right and left facing sides of the bed, are similar and symmetrically disposed, except for some differences to be described hereinafter, only the connections on one side will be described. The side shown in FIGS. 1, 2, 3 and 4 is the left facing side of the bed, which is the side on the left side of a person standing in front of the foot end of the bed and looking torward the head end of the bed. The connections are shown when a person standing at the left facing side of the bed looks toward the outside of the left facing side of the bed.

The chassis 59 (FIG. 1) is in a vertical plane, and has a horizontally extending portion 59*a* from the left end of which a vertically extending portion 59*b* projects upwardly. Pivoted to portion 59*a* of the chassis, as at 60 is a main lever 61. The chassis can be fixed to the wood frame 11 in any suitable usual manner. Said lever 61 comprises an arm 62 extending up from pivot 60. Said arm 62 extends upwardly as shown in FIG. 1, to a height above pivot 23. At its upper end is a forwardly extending arm 61*a* which carries a pivot pin or rivet 63. Extending from the lower end of arm 62 in arm 64 which projects to the rear in the FIG. 1 (sleeping) position of the bed. Pivoted to arms 64 at opposite sides of the bed (one side is illustrated) as at 65, is a tension link 68 formed with three equiangularly spaced openings 69 on equal radii from the axis of rivet 65. Tension link 68 has a shoulder edge 68*a* spaced from a shoulder 64*a* on arm 64 when the bed is in pulled out, open sleeping position, as shown in FIG. 1.

Figure 5:
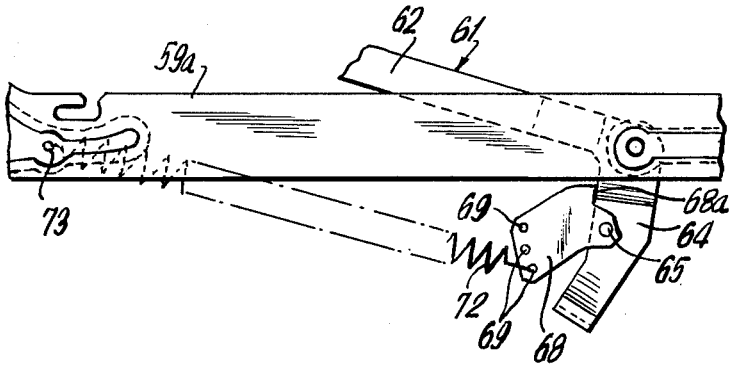
FIG. 5 is a side elevational view of the tensioning mechanism to help pull the bed from fully collapsed toward open position, and showing the tension spring connected for greatest tension and the bed in partially collapsed condition.
Figure 6:
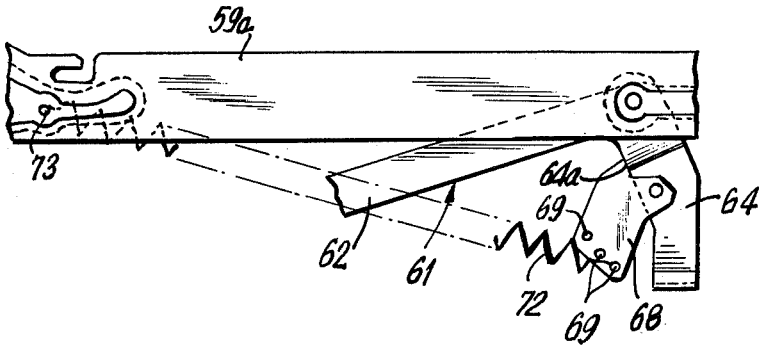
FIG. 6 is a view similar to FIG. 5 but showing the bed in fully collapsed condition.

Upon closing the bed, the main lever moves from the position of FIG. 1 to the position of FIG. 5 and then to the position of FIG. 6.

A coil tension spring 72 connects a selected one of the holes 69 with an anchoring pin 73 on arm 59*a* of the chassis, close to arm 59*b.* Spring 72 biases the main lever 61 to rotate in a clockwise direction (FIG. 1).

Pivoted to the upper end of arm 59*b* of chassis 59, as at 74, is a rear swing link 75 having an arm 75*a* inclined downwardly and forwardly as shown in FIG. 1, and an arm 75*b* inclined upwwardly and forwardly from its junction with said arm 75*a.* At such junction is a pivot pin 76. Pivoted to the forward end of arm 75*b,* as at 76*a,* is a rear throwout link 77. Link 77 has a first straight arm 77*a* inclined upwardly and forwardly, a second straight arm 77*b* inclined upwardly and forwardly from the forward end of arm 77*a,* but at a lesser angle to the horizontal.

The upper end of the arm 62 of the main lever 61 is pivoted about said pivot 63. Extending from the forward end of arm 77*b* is an arm 77*c* inclined slightly downwardly and forwardly and carrying a pivot pin 78 at its forward end disposed just above angle 22 of the long intermediate section 15.

Pivoted to pivot 76, at the junction of arms 75*a,* 75*b* of lever 75, is one end of rear control link 80, which, as shown in FIG. 1, projects upwardly and forwardly and is located above pivot pin 76*a.* Pivoted to the forward end of link 80, as at 81, is a rear guide link 82, shaped like a bellcrank, and having a first arm 82*a* inclined slightly upwardly and extending forwardly, as shown in FIG. 1, and being pivoted to said pivot pin 23, and having a downwardly and rearwardly inclined arm 82*b.* The lower ends of arms 82*b* on opposite sides of the bed may be interconnected by a cross tube (not shown).

Link 77 crosses link 82 at the junction of arms 77*a,* 77*b* of said link 77, and is pivoted to arm 82*a* of said link 82 where they cross, by pivot pin 85.

Flange 22*a* of angle 22 is formed with a longitudinal slot 86 (FIG. 1). Rotatably and slidably extending through said slot 86 is a pin 87 passing through a hole 88*a* in the right end of a latch 88 as shown in FIG. 1. Latch 88 is only located at the left facing side of the bed, that is at the side of the bed which is on the left side of a person standing in front of the foot of the bed and facing the bed.

The purpose of latch 88 is to alternately lock and release the head section as said head section is moving up and down. This structure is shown and described in said U.S. Pat. No. 3,984,883 and need not be further described herein because it does not form a part of the invention covered herein.

Pin 87 interpivots latch 88 to a T. V. support link 94 formed with a hole 94*a* at its outer end. Fixed to flange 20*a* of rear side angle 20 is a bracket 95 having a tongue 96 projecting beyond said flange and carrying a pin 97 disconnectably engageable in hole 94*a* of link 94. When link 94 is disconnected from pin 97, it can be swung away from angle 20 which can then be swung clockwise, looking at FIGS. 1, to overlie section 14 of the bed, and to allow foot section 16 to be swung up and then allow sections 15 and 16 to be folded together, with section 16 disposed over section 14 and the inwardly and downwardly folded section 13, to make a compact package to facilitate shipment.

Pivoted to the flange 22*a* of main angle 22, as on pivot 105 (FIG. 1), is a main bellcrank 106 having a rearwardly and upwardly extending arm 106*a* pivoted to arm 77*c* of the rear throwout link 77 by said pivot pin 78. Said main bellcrank 106 also has an arm 106*b* projecting forwardly and more steeply downwardly as seen in FIG. 1, and carrying a pivot 107 at its lower end.

Pivot pin 107 is connected by a rear leg link 108 to pin 46*g* of the rear leg 45, and is located below the main section when the bed is open as shown in FIG. 1, in which position leg 45 is vertical. Flange 22*a* of main angle 22 is formed with a longitudinal slot 114 in which pivot pin 113a slides. In the open position of FIG. 1, pin 113*a* is at the front end of slot 114.

Pivoted to arm 106*b* of the main bellcrank 106, as at 106*c* is a slotted lock link 109 formed at its outer end with a radial slot 109*a.*

Pivoted to flange 22*a* of main angle 22, as at 110, is a secondary bellcrank 110*a* having curved portion 110*b* extending from pivot pin 110, bent up and forward and terminating in an arm 110*c* projecting downwardly to a point below angle 22. On the lower end of arm 110*c* is a pin 110*d* projecting into slot 109*a.* In the FIG. 1 position of the bed, the slotted lock link 109 slants downwardly and forwardly from its pivot 108.

Pivoted to a pivot pin 28 at the apex portion 27 of vertical flange 25*a* of the central or that intermediate angle 25, is an intermediate portion of a main lock link 112 having one arm 112*a* inclined rearwardly and downwardly. A lock sequence link 113 is pivoted at its front end by pivot 113*a* to the rear end of arm 112*a* of the main lock link. Said lock sequence link 113 is pivoted at its rear end by pivot 113*b* to the curved portion 110*b* of the secondary bellcrank 110*a,* at a point somewhat above pivot 110 when the bed is in the FIG. 1 open position thereof.

The main lock link 112 has an arm 112*b* inclined forwardly and downwardly from pivot pin 28, when the bed is opened up fully. Pivoted to the outer end of said arm 112b as at 117 is the rear end of foot section lock link 118 of Z shape. The rear end of said foot section lock link 118 is pivoted as at 120 to arm 32*a* of foot section 32. A front leg link 124 is pivoted as at 122, to the upper end 48*b* of front leg 48, and as at 125 to the central angle 25 rearwardly of pivot 34 which connects the front section 32 to the central section.

Sequence of operation is as following:

Starting with the bed in the fully opened position (FIG. 1) herein, the position of the Secondary Bell Crank is such that the Slotted Lock Link hangs freely from the connection part on the Main Bell Crank and the connection point of the Lock Sequence Link to the Secondary Bell Crank is slightly above center of the axis of the connection point of the Secondary Bell Crank to the Main Angle and the slot in the Main Angle which the rivet connecting the Lock Sequence and Main Lock Link passes. When the bed is folded to the first position (FIG. 2) the Lock Sequence Link is pushed by the rivet in the Main Lock Link and because of the starting above center condition causes the Secondary Bell Crank to rotate in a counter clockwise direction thus causing the Slotted Lock Link to be repositioned into an upward position relative to the Main Bell Crank.

Next when the bed is lifted and pushed into the frame the Main Bell Crank begins to rotate in a clockwise direction — it quickly takes up the slack in the joint of the slotted lock link and Secondary Bell Crank and at the point where it is approximately half way into the sofa frame (FIG. 3) begins to pull on the Secondary Bell Crank thus pulling on the Lock Sequence Link, and thus on the Main Lock Link, etc., thus compressing the mattress and effecting the interference condition of the lock.

In FIG. 4 the bed is fully closed and the lock fully operative when the pivot centers of Main Bell Crank/-Slotted Lock Link, Slotted Lock Link/Secondary Bell Crank, and Main Bell Crank/Main Angle are in line. The centers of the Main Lock Link/Lock Sequence Link; Lock Sequence Link/Second Bell Crank; and Second Bell Crank/Main Angle are also in line and an $\frac{1}{8}$ inch interference condition exists between them.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

We claim:

1. A folding bed comprising a chassis, a main lever pivoted to said chassis, said main lever having an arm extending upwardly from said pivot, in the open position of said bed, linkage connecting said chassis to the upwardly extending arm of said main lever, said bed having a main section, means to pivotally connect the rear end of said main section of said linkage, a central section pivoted to the forward end of said main section, a foot section pivoted to the forward end of said central section, a main bell crank pivoted to said main section and having an arm extending rearwardly, in the open position of said bed, and pivoted to said linkage, a slotted lock link pivoted to said main bell crank, said slotted lock link having a radial slot, a secondary bell crank piovted to said main bed section, a pin on said secondary bell crank, slidably received in said slot in said slotted lock link, a main lock link pivoted to said central section and having an arm projecting rearwardly, in the open position of said bed, a lock sequence link connecting said arm of said main lock link to said secondary bell crank, said main lock link having an arm extending forwardly of its pivotal connection to said central section, in the open position of said bed, and a foot section lock link connecting said forwardly extending arm of said main lock link to said foot section.

2. The combination of claim 1, the pivot of said rearwardly extending arm of said main lock link to said secondary bell crank being located above the level of the pivotal connection of said secondary bell crank to said main section, in the open position of said bed.

3. The combination of claim 1, said main section having a slot slidably receiving the pivot which connects said main lock link to said lock sequence link.

4. The combination of claim 2, said main section having a slot slidably receiving the pivot which connects said main lock link to said lock sequence lever.

5. A folding bed comprising a main bed section, a central bed section pivoted to said main section, a foot section pivoted to said central section, a main bell crank pivoted to said main section, a slotted lock link pivoted to said main bell crank and having a radial slot, a secondary bell crank pivoted to said main section, and a pin on said secondary bell crank slidably received in said slot in said slotted lock link, a main lock link pivoted to said central section and having an arm extending rearwardly of the pivotal connection of said main lock link to said central section, in the open position of said bed, and a lock sequence link pivotally connected to said rearwardly extending arm of said main lock link and also pivotally connected by a pivot pin to said secondary bell crank, said main lock link having an arm extending forwardly, in the open position of the bed, and a foot section lock link pivoted at one end to said forwardly extending arm of said main lock link, and at its other end to said foot section.

6. The combination of claim 5, said point of connection of said lock sequence link to said secondary bell crank, being at a higher level than the pivotal connection of said secondary bell crank to said main section, in the open position of said bed.

7. The combination of claim 5, said main section having a longitudinal slot, the pivot of said main lock link to said lock sequence link being slidable in said slot.

8. The combination of claim 7, said point of connection of said lock sequence link to said secondary bell crank, being at a higher level than the pivotal connection of said secondary bell crank to said main section, in the open position of said bed.

9. The combination of claim 1, said main lever having an arm extending rearwardly of its pivotal connection to said chassis, in the open position of the bed, a tension line pivoted to said rearwardly extending arm of said main lever, and a coil tension spring connecting said tension link to said chassis.

10. The combination of claim 9, said rearwardly extending arm of said main lever having a shoulder spaced from an abutting shoulder on said tension link, during an initial rotation of said main lever to allow rotation of said arm relative to said tension link, when folding the bed, and to then abut said abutting shoulder on said tension link upon continuing rotation of said main lever, to rotate said tension link together with said arm relative to said chassis.

11. The combination of claim 10, said tension link having a plurality of spaced holes equidistant from the pivotal connection of said tension link to said rearwardly extending arm of said main lever.

12. A folding bed comprising a chassis, a main lever pivoted to said chassis and having an upwardly extending arm and a rearwardly extending arm, linkage connected to said chassis and to said upwardly extending arm of said main lever, a main bed section, a main bell crank pivoted to said main section and pivotally connected to said linkage, a tension link pivoted to the rearwardly extending arm of said main lever, and a coil tension spring pivoted at one end to said chassis and at its other end to said tension link.

13. The combination of claim 12, said tension link being rotatable relative to said rearwardly extending arm of said main lever and means on said rearwardly extending arm and tension link, to cause said arm to move said tension link together with movement of said arm about the pivot of said main lever to said chassis.

14. The combination of claim 13, said tension link being formed with a plurality of angularly spaced anchors arranged equidistantly from the pivotal connection of said tension link to said main lever, for selective engagement with one end of said coil tension spring.

15. The combination of claim 5, said main bell crank having an arm extending forwardly in the open position of said bed, said slotted lock link being pivoted to said arm of said main bell crank.

16. The combination of claim 15, a rear leg pivoted to said main section, said arm of said main bell crank projecting downwardly in the open position of said bed, and a rear leg link connecting said rear leg to said downwardly projecting arm of said main bell crank.

17. The combination of claim 16, said secondary bell crank having a downwardly extending arm, in the open position of said bed, and said pin on said secondary bell crank being located at the lower end of said arm.

18. The combination of claim 17, the pivot centers of the main bell crank to the slotted lock link, of the slotted lock link to the secondary bell crank and of the main bell crank to said main section, being substantially in line, in the fully closed position of the bed, in which position the locking of the sections of the bed is fully operative.

19. The combination of claim 18, the pivot centers of the main lock link to the lock sequence link, of the lock sequence linkto the secondary bell crank and of the secondary bell crank to the main section being also substantially in line in the fully closed position of said bed.

20. The combination of claim 5, said main section having a longitudinal slot, the pivot of said main lock link to said lock sequence link being slidable in said slot, said pin on said secondary bell crank being spaced from the ends of the slot in said slotted lock link, and the pivotal connection of said main lock link with said lock sequence link being at the front end of the slot in said main section, when the bed is in fully open position, a rear leg pivoted to the pivotal connection of said main section to said central section, a rear leg link connecting said rear leg to said main bell crank, a front leg pivoted to said foot section, a front leg link connecting said front leg to said central section, said front section being movable upwardly to a position at right angles to said central section, and then said central section being movable to a position extending upwardly from said main section to bring said foot section into overlying spaced position above said main section, in a first fold position of said bed, said foot section lock link, main lock link, lock sequence link and secondary bell crank having means to swing said slotted lock link upwardly about its pivot to said main bell crank and to swing said secondary bell crank about its pivot to the main section, to bring the pin on the secondary bell crank closer to the radially inner end of said slot in said slotted lock link and to bring the pivot which connects the main lock link to said lock sequence link close to the rear end of the horizontal slot in said main section, said main section being movable to a rearwardly and downwardly inclined second fold position to bring said pin in said slot in said slotted lock link to the radially outer end of said slot in said slotted link and to hold the pivotal connection of said main lock line sequence link, close to the rear end of said horizontal slot in the main section, said main section. central section and foot section being then movable to a fully closed position causing said slotted lock link to pull against the pin on the secondary bell crank rearwardly and downwardly to thereby cause the secondary bell crank to pull the lock sequence link rearwardly to pull the main lock link rearwardly to exert a rearward pull on the main lock link and to bring the pivotal point of the main bell crank to the slotted lock link substantially into line with the pivotal connection of the main bell crank to the main section and the pivotal connection of the pivot pin on the secondary bell crank that is engaged with the radially outer end of the slot in the slotted lock link and also bringing the pivotal connection of the main lock link with the lock sequence link substantially in line with the pivotal connection of the lock sequence link with the secondary lock link and with the pivotal connection of the secondary bell crank with the main section.

21. The combination of claim 20, a chassis, a main lever pivoted to said chassis and having an upwardly extending arm, linkage connecting said chassis to said upwardly extending arm of said main lever, and means to pivotally connect the rear end of said main sectiion to said linkage and means to connect said linkage to said main bell crank.

22. The combination of claim 5, said main section having a longitudinal slot, the pivot of said main lock link to said lock sequence link being slidable in said slot, said pin on said secondary bell crank being spaced from the ends of the slot in said slotted lock line, and the pivotal connection of said main lock link with said lock sequence link being at the front end of the slot in said main section, when the bed is in fully open position.

23. The combination of claim 22, said front section being movable upwardly to a position at right angles to said central section, and then said central being movable to a position extending upwardly from said main section to bring said foot section into overlying spaced position above said main section, in a first fold position of said bed, said foot section lock link, main lock link, lock sequence link and secondary bell crank, having means to swing said slotted lock link about its pivot to said main bell crank and to swing said secondary bell crank about its pivot to said main section, to bring the pin on the secondary bell crank closer to one radial end of said slot in said slotted lock link and to bring the pivot which connects the main lock link to said lock sequence link closer to the rear end of the horizontal slot in said main section.

24. The combination of claim 23, said main section being movable to a rearwardly and downwardly inclined second fold position to bring said pin in said slot in said slotted lock link to the other radial end of said slot in said slotted link and to hold the pivotal connection of said main lock link to said lock sequence link, close to the rear end of said horizontal slot in the main section, said main section, central section and foot section being then movable to a fully closed position causing said slotted lock link to move the pin on the secondary bell crank to thereby cause the secondary bell crank to pull the lock sequence link rearwardly to pull the main lock link rearwardly.

25. The combination of claim 24, and to bring the pivotal point of the main bell crank to the slotted lock link substantially into line with the pivotal connection of the main bell crank to the main section and the pivotal connection of the pivot pin on the secondary bell crank that is engaged in the slot in the slotted lock link, and also bringing the pivotal connection of the main lock link with the lock sequence link substantially in line with the pivotal connection of the lock sequence link with the secondary bell crank and with the pivotal connection of the secondary bell crank with the main section.

* * * * *